US009004276B2

(12) United States Patent
Brown et al.

(10) Patent No.: US 9,004,276 B2
(45) Date of Patent: Apr. 14, 2015

(54) PACKING ASSEMBLY FOR CAR FLOOR MATS

(71) Applicant: Who-Rae Pty Ltd, South Melbourne, Victoria (AU)

(72) Inventors: Warwick James Brown, North Melbourne (AU); Giles Frederick Matthews, Hawthorn (AU)

(73) Assignee: Who-Rae Pty Ltd (AU)

( * ) Notice: Subject to any disclaimer, the term of this patent is extended or adjusted under 35 U.S.C. 154(b) by 28 days.

(21) Appl. No.: 13/893,603

(22) Filed: May 14, 2013

(65) Prior Publication Data

US 2014/0202901 A1 Jul. 24, 2014

(30) Foreign Application Priority Data

Jan. 21, 2013 (AU) ..... 2013900190
Apr. 8, 2013 (AU) ..... 2013202939

(51) Int. Cl.
*B65D 85/00* (2006.01)
*B65D 33/14* (2006.01)
*A47F 7/16* (2006.01)

(52) U.S. Cl.
CPC . *B65D 85/54* (2013.01); *A47F 7/16* (2013.01); *B65D 33/14* (2013.01)

(58) Field of Classification Search
CPC ... B65D 85/70; A41D 27/22; A47G 25/4023; A47G 25/4038; A47G 25/4015; A47G 25/40
USPC ..... 220/4.22, 4.23, 751, 756, 752; 206/335, 206/278, 282, 288, 806, 279, 299, 289, 206/287.1, 287; 223/94, 89, 88, 85
See application file for complete search history.

(56) References Cited

U.S. PATENT DOCUMENTS

| | | | | | |
|---|---|---|---|---|---|
| 1,786,923 | A | * | 12/1930 | Scruby | 223/88 |
| 2,855,649 | A | * | 10/1958 | Kanter | 223/87 |
| 3,841,478 | A | * | 10/1974 | Wells et al. | 206/495 |
| 3,899,078 | A | * | 8/1975 | Ambrozetes et al. | 206/335 |
| 4,190,151 | A | * | 2/1980 | Russell | 206/281 |
| 5,297,706 | A | * | 3/1994 | Blitz | 223/96 |
| 2007/0145085 | A1 | * | 6/2007 | Masanek, Jr. | 223/96 |
| 2010/0089933 | A1 | * | 4/2010 | Branger | 220/751 |

FOREIGN PATENT DOCUMENTS

| | | |
|---|---|---|
| DE | 1611745 | 1/1971 |
| FR | 2653185 A1 | 4/1991 |
| GB | 2458576 A | 9/2009 |

OTHER PUBLICATIONS

Extended European Search Report issued in corresponding European Patent Application No. 13002723.6 on May 6, 2014, consisting of 5 pp.

* cited by examiner

*Primary Examiner* — Robert J Hicks
(74) *Attorney, Agent, or Firm* — Volpe and Koenig, P.C.

(57) ABSTRACT

A packaging assembly for car floor mats including a main body portion; at least one support member extending from the main body portion, and a securing arrangement releasably secured to the support member, wherein at least one car floor mat can be retained on the support member when the securing arrangement is secured to the support member, and wherein the at least one car floor mat can be removed from the packaging assembly when the securing arrangement is released from the support member.

7 Claims, 7 Drawing Sheets

PACKING ASSEMBLY FOR CAR FLOOR MATS

FIELD OF INVENTION

The present invention is generally directed to packaging for retail products, and in particular to a packaging for goods hung for display. While the present invention will be described with respect to its application for packaging car floor mats, it is to be appreciated that the invention is not limited to this application, and that other applications are also envisaged.

BACKGROUND

Car floor mats are typically hung up for display in retail outlets selling such products. The packaging for such car floor mats generally comprises a cardboard sheet which is folded in the middle to provide two leaves between which can be located end portions of each car floor mat in a sandwich arrangement. Securing means such as staples are used to secure and retain the car floor mats between the cardboard leaves. The cardboard sheet may also be cut to form a hook, or a separate hook may be secured to the cardboard sheet to allow hanging of the products.

A problem with such packaging is that it is difficult or not possible to repack the car floor mats once they have been separated from the packaging. Therefore, if the car floor mats are for any reason returned to the shop, it is difficult or not possible to reuse the packaging to resell the product. This may be due to not having the means to resecure the car floor mats again to the packaging or due to damage to the packaging when the car floor mats were initially separated from the packaging. Even if the shop attempts to repackage the car floor mats, the resultant repacked product may be unattractive. This can have the effect of customers not being prepared to purchase such repackaged products.

It would therefore be advantageous to have packaging that overcomes the disadvantage of known packaging.

SUMMARY

According to the present invention, there is provided a packaging assembly for car floor mats including a main body portion; at least one support member extending from the main body portion, and a securing arrangement releasably secured to the support member, wherein at least one car floor mat can be retained on the support member when the securing arrangement is secured to the support member, and wherein the at least one car floor mat can be removed from the packaging assembly when the securing arrangement is released from the support member.

The securing arrangement may include a locking tab supported on the main body portion and having a lock for engaging the support member. The lock may include an engagement member rotatably supported on the locking tab for engaging the support member in a first rotational position, and for disengaging the support member in a second rotational position. The support member may include a cooperating lip, and the engagement member may include an abutment for engaging a cooperating lip when the engagement member is in the first rotational position, the abutment being disengaged from the cooperating lip in the second rotational position. The locking tab may include a hinged portion supporting the lock, and allowing pivotal motion of the lock towards and away from the support member. The lock may further include a handle hinged to the lock. The handle can rest flush against the locking tab when not in use, and can be hinged away from the locking tab for use when rotating the lock.

The use of alternative securing arrangements for securing the car floor mat to the packaging assembly is also envisaged.

Preferably two or more said support members may be provided on the main body portion, with separate securing arrangements provided for each support member. The main body portion may include an integral hook portion for hanging the packaging assembly. The main body portion may also include a planar extension for providing a support surface thereon. This provides an area on the packaging assembly for supporting advertising and branding information.

The car floor mats may include one or more apertures which enable the car floor mat to be passed over the support member(s) and retained in position by the securing arrangement(s). The car floor mat may be moulded in rubber or similar material with an integral tab moulded on an edge of the floor mat. One or more apertures may be provided in the tab. It is also envisaged that a separate means may be provided to secure mats that do not have any apertures within the mat to be supported on the support member. For example, a tab member may be secured to the floor mat using staples, adhesive or other securing means, with an aperture being provided through the tab member to allow the support member to pass therethrough.

The floor mats can be removed from the packaging assembly by releasing the securing arrangement(s). The car floor mats can then be removed from the support members. The packaging assembly can however be reused by replacing the car floor mats on the support members and resecuring the securing arrangement to the support member.

According to a preferred embodiment of the present invention, there is provided a packaging assembly for car floor mats including first and second body portions, the body portions being connected together by at least one hinge, such that the body portions can be pivotally displaced between a closed position where the body portions are located in an immediately adjacent relation, and an open position where the body portions are separated; at least one support member extending from the first body portion towards the opposing second body portion when the body portions are in the closed position, and a securing arrangement for releasably securing together the first and second body portions when in the closed position, wherein at least one car floor mat can be supported on the support member such that at least a portion of the car floor mat is retained between the first and second body portions when in the closed position.

Preferably two or more said support members may be provided on the first body portion. The securing arrangement may be provided between each support member and the second body portion. Alternatively, the securing arrangement may be provided between the first and second body portions.

According to a preferred embodiment of the invention, the support member may be in the form of an elongate post extending from the first body portion, and the securing arrangement may include an engagement tag provided at a free end of the support member. The securing arrangement may further include a cooperating aperture provided in the second body portion through which the engagement tag may pass when the first and second body portions are in the closed position. The engagement tag may have a peripheral lip adapted to engage a peripheral edge of the cooperating aperture once the body portions are in the closed position. This securing arrangement may therefore hold together the two body portions when in the closed position and thereby retain any car floor mat supported by the packaging assembly. The securing arrangement may be released by deflecting the support member relative to the cooperating aperture such that the peripheral lip of the engagement tag is disengaged from the peripheral edge of the cooperating aperture thereby allowing clearance for the engagement tag to pass back out through the aperture.

According to another preferred embodiment of the invention, the support member may be in the form of a hollow post extending from the first body portion. The securing arrangement may include a resilient V-shaped clip provided on the second body portion, and a cooperating chamber may be provided in the support member for accommodating the V-shaped clip when the first and second body portions are in the closed position. The V-shaped clip may have an arm upon which is provided a peripheral lip for engaging an undercut shoulder provided within the cooperating chamber of the support member when the V-shaped clip is inserted into the chamber in the closed position. The arm of the V-shaped clip may extend out of an aperture provided in the second body portion to allow deflection of that arm relative to the aperture. The securing arrangement may be released by deflecting the arm of the V-shape clip such that the peripheral lip is disengaged from the undercut shoulder thereby allowing the V-shaped clip to be extracted from the chamber thereby allowing opening of the packaging assembly.

According to a further preferred embodiment of the invention, the support member may be in the form of an elongate post having a horse-shoe cross-section. The securing arrangement may include a straight arm clip extending from the first body portion and encompassed by the horse shoe support member, with an engagement tag being provided at the free end of the straight arm clip. The engagement tag may have a peripheral lip, and a cooperating aperture may be provided in the second body portion, the peripheral lip engaging a peripheral edge of the cooperating aperture when the first and second body portions are in the closed position. The securing arrangement can be released by deflecting the straight arm clip such that the peripheral lip is disengaged from the peripheral edge of the cooperating aperture thereby allowing opening of the packaging assembly.

The use of alternative securing arrangements between the first and second body portions is also envisaged.

The car floor mats may include one or more apertures which enable the car floor mat to be passed over the support member(s) when the body portions are in their open position. Displacement of the body portions to the closed position results in the portion of the car floor mat supported on the support member(s) being retained between the body portions. The car floor mat may be moulded in rubber or similar material with an integral tab moulded on an edge of the floor mat. One or more apertures may be provided in the tab. It is also envisaged that a separate means may be provided to secure mats that do not have any apertures within the mat to be supported on the support member. For example, a tab member may be secured to the floor mat using staples, adhesive or other securing means, with an aperture being provided through the tab member to allow the support member to pass therethrough.

At least one of the body portions may include a main planar wall, and one or more peripheral walls extending along part of the periphery of the main wall. An inner chamber for accommodating a portion of the car floor mat may then defined when the first and second body portions are in the closed position. The inner chamber may have an elongate opening to allow for part of the car floor mat to extend outside of the packaging assembly.

The hinge(s) may be provided between the peripheral walls of the first and second body portions. The hinge may be in the form of a pin hinge similar to that used for doors, with the first and second body portions respectively supporting a hinge section having holes for accommodating an elongate hinge pin. It is however also envisaged that the hinge may be formed from a length of resilient material such as plastic, and preferably polypropylene, having a central bend line. Such a hinge may be respectively secured to the first and second body portions to provide the hinge. Alternatively, the hinge may be integrally formed with the body portions. According to another possible arrangement, one or both of the body portions may preferably be formed with one or more integrally formed hinge tabs that have a bend line which allows pivotal movement of the hinge tab relative to the body portion. The hinge tabs may then be secured to the other body portion using fastening means such as clips or using other means such as adhesive or plastic welding methods.

The body portions may be respectively formed with an integral hook portion to allow hanging of the packaging together with the packaged products. Each body portion may be formed to provide a hook portion which forms a hook for the packaging once the two body portions are in their closed positions.

At least one of the body portions may include a planar extension which may provide a support surface upon which a label providing product information may be applied. A handle portion may also be provided within each body portion to facilitate holding of the packaged products. It is also to be appreciated that a hook, and/or handle portion may be formed separately from the body portions and may be subsequently secured to the body portions.

The packaging assembly may be formed from a material having stronger material properties than cardboard. Preferably, each body portion can be injection moulded from plastic material such as polypropylene or ABS. The use of other materials is also envisaged.

The floor mats can be removed from the packaging assembly by releasing the securing arrangement and displacing the body portions to the open position. The car floor mats can then be removed from the support members. The packaging assembly can however be reused by replacing the car floor mats on the support members and displacing the body portions back to the closed position such that the securing arrangement is again secured to the second body portion.

The packaging assembly according to the present invention can be readily reused, even after the products have been removed from the packaging. This therefore facilitates repackaging of the products if required. The construction of the packaging assembly also potentially reduces any damage to the packaging following opening thereof. The packaging assembly can also be used to support the car floor mat when it needs to be washed, for example, when being hosed down with water. This provides an additional use for the packaging assembly after purchase of the product.

BRIEF DESCRIPTION OF THE DRAWINGS

It will be convenient to further describe the invention with reference to the accompanying drawings which illustrate preferred embodiments of the present invention. Other embodiments are possible, and consequently, the particularity of the accompanying drawings is not to be understood as superseding the generality of the preceding description of the invention.

In the drawings.

DETAILED DESCRIPTION OF THE PREFERRED EMBODIMENTS

Figures 1, 2, 3:
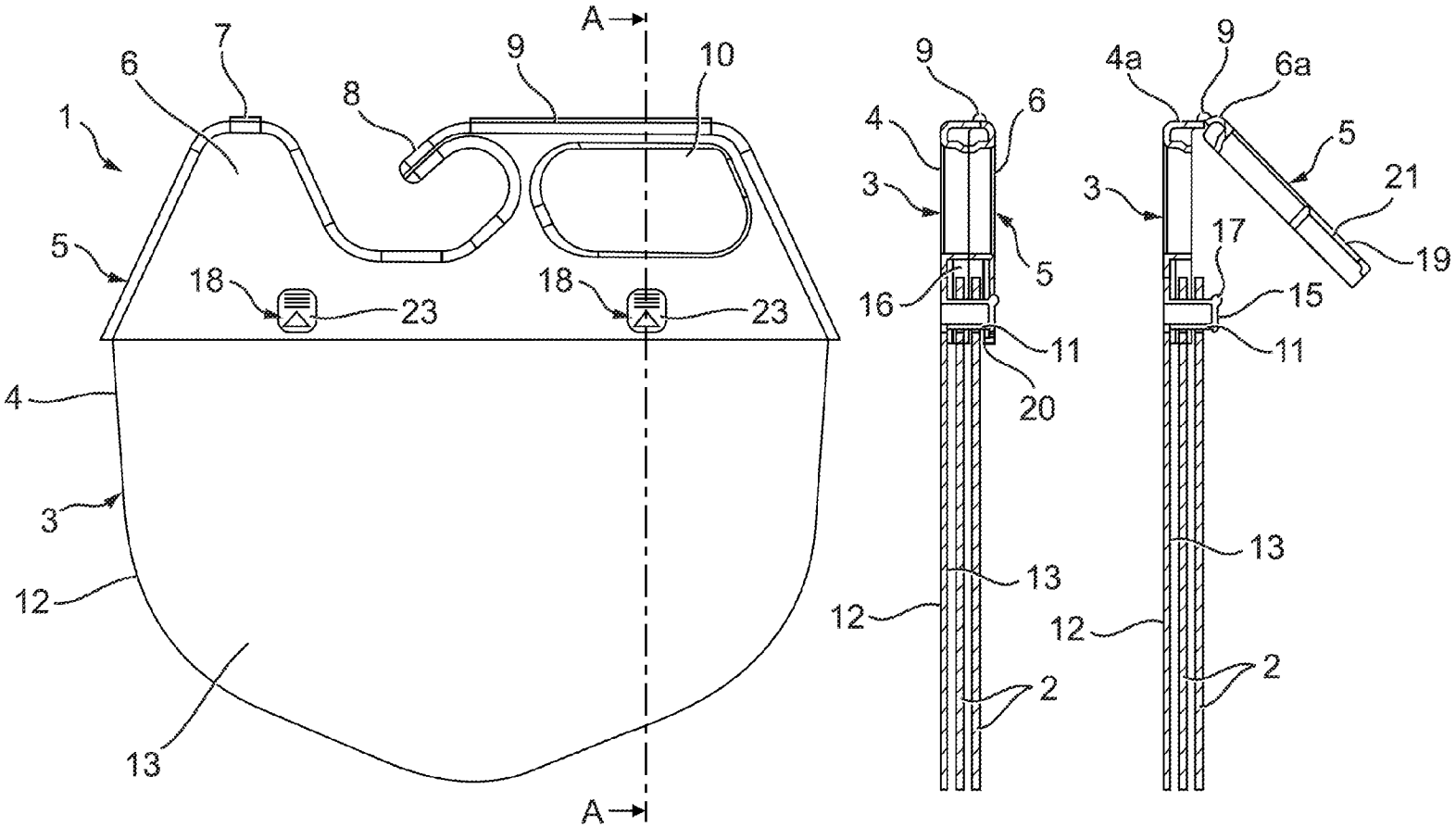
FIG. 1 is a rear view of a first preferred embodiment of a packaging assembly according to the present invention.
FIG. 2 is a side cross sectional view taken along section A-A of the packaging assembly shown in FIG. 1 supporting two car floor mats and in a closed position.
FIG. 3 is a side cross sectional view taken along section A-A of the packaging assembly of FIG. 1 showing two car floor mats being supported and when in an open position.

More than one embodiment of the packaging assembly 1 of the present invention will be described, and the same reference numeral is used for corresponding features for clarity reasons.

Referring initially to FIGS. 1 to 3, the packaging assembly 1 includes a first body portion 3 and a second body portion 5. Each body portion 3,5 includes a main planar wall 4,6 and peripheral walls 4*a*,6*a* extending along part of the periphery of the main planar wall 4,6. The first and second body portions 3, 5 are connected to each other through a first and second hinge 7, 9 secured to the peripheral walls 4*a*,6*a*. The first and second body portions 3, 5 can therefore be moved relative to each other between a closed position as shown in FIG. 2, and an open position as shown in FIG. 3. In the closed position, the first and second body portions 3, 5 are located in an immediately adjacent relation, and an inner chamber 16 is defined therebetween, the inner chamber 16 having an elongate opening 20 along the bottom. In the open position, the second body portions 5 is hinged away from the first body portion 3.

The first body portion 3 further includes two support members 11 shown in cross section in FIGS. 2 and 3. Each support member 11 is in the form of an elongate post extending from an inner face 13 of the main planar wall 4 of the first body portion 3 towards the second body portion 5 when the packaging assembly is in its closed position. A securing arrangement 18 is provided between the support member 11 and the second body portion 5, and includes an engagement tag 15 having a peripheral lip 17 provided at the free end of each support member 11. The securing arrangement 18 further includes cooperating apertures 19 provided through the main planar wall 6 of the second body portion 5. Each cooperating aperture 19 is sized and positioned to allow the engagement tag 15 of the adjacent support member 11 to pass through the aperture 19 when the body portions 3,5 are in the closed position. The peripheral lip 17 engages a peripheral edge 21 of the cooperating aperture 19 when in the closed position to thereby hold and retain together the first and second body portions 3, 5 in the closed position.

FIGS. 2 and 3 show two car floor mats 2 supported on the support member 11 through apertures provided in the car floor mats 2. A portion of the car floor mats 2 are accommodated within the inner chamber 16 defined between the first and second body portions 3,5 when closed. The rest of the car floor mats 2 extend out from the elongate opening 20 of the inner chamber 16. When the packaging assembly 1 is in its closed position as shown in FIG. 2, it is not possible to remove the car floor mats 2 from the packaging assembly 1.

The engagement tag 15 of each support member 11 has an upper contact surface 23. This allows a downward force to be applied to each support member 11. This downward force deflects the support member 11 to thereby separate the peripheral lip 17 from the peripheral edge 21 of the cooperating aperture 19 thereby releasing the second body portion 5 from the first body portion 3 thereby allowing the tag member 15 to pass back through the aperture 19. This therefore releases the securing arrangement 18 allowing the second body portion 5 to be hinged away from the first body portion 3 to an open position as shown in FIG. 3. The car floor mats 2 can then be removed from the packaging assembly 1.

The packaging assembly 1 further includes an integrally formed hook member 8 to allow the packing assembly 1 together with car floor mats 2 packaged therein to be hang up for display in a retail outlet. One half of the hook 8 may be respectively formed as part of each body portion 3, 5. Therefore, the complete hook 8 is formed when the body portions are in the closed position. A handle portion 10 may also be separately formed in each body portion. When the body portions 3, 5 are in the closed position, the handle 10 can be used to carry the packaging assembly together with the packaged products.

The main planar wall 4 of the first body portion 3 also includes a planar extension 12 that provides a surface area upon which a label providing product information may be supported.

Figure 4:
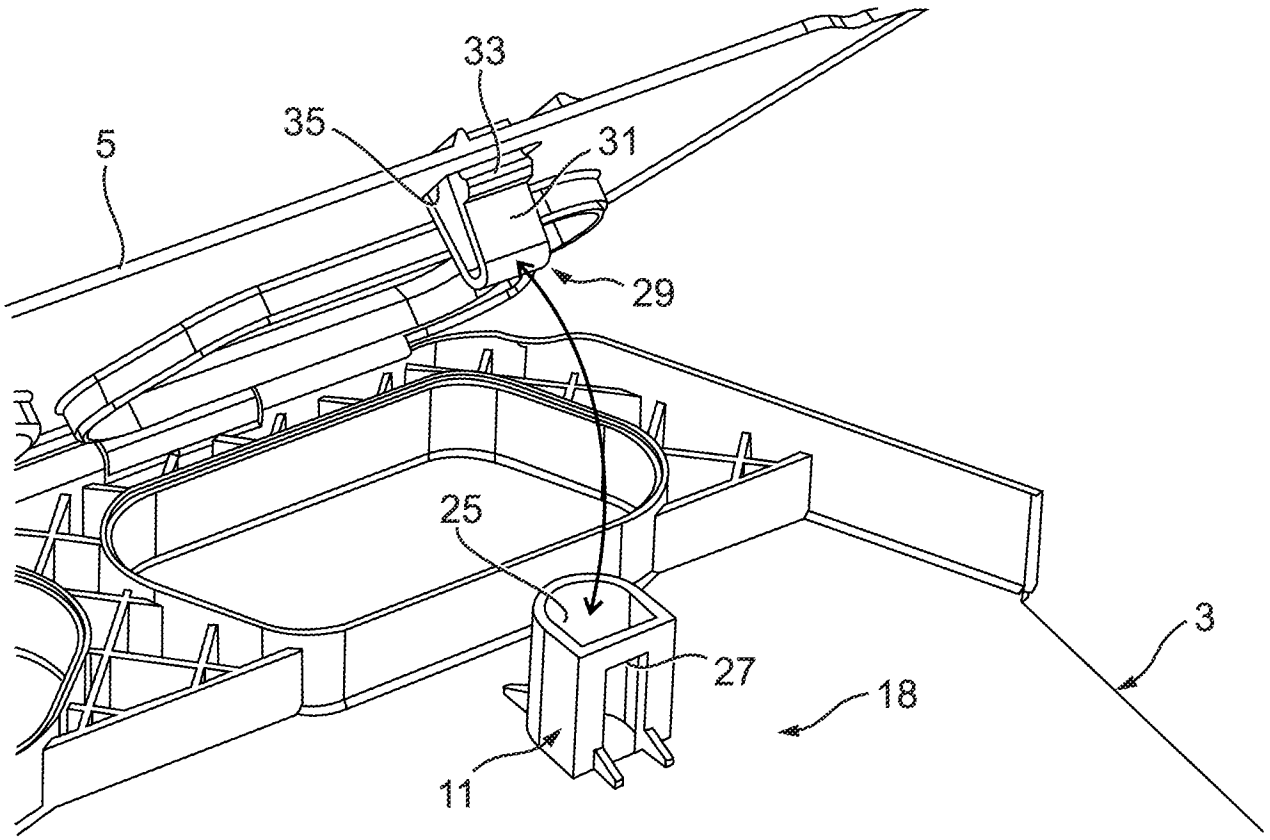
FIG. 4 is a detailed perspective view of a second preferred embodiment of the packaging assembly according to the present invention.

FIG. 4 shows an alternative possible embodiment of the securing arrangement 18 for the packaging assembly 1. In this embodiment, the securing arrangement 18 includes the support member 11 being in the form of a hollow post extending from the first body portion 3. The support member 11 has an inner chamber 25, and an undercut shoulder 27 provided as part of that chamber 25. Extending from the second body portion 5 is a V-shaped clip 29 having a V-shaped arm 31. A peripheral lip 33 is provided at the end of the V-shaped arm 29, the end of the arm 29 extending through an aperture 35 provided in the second body portion 5. When the first and second body portions 3, 5 are in the closed position, the V-shaped clip 29 is accommodated within the chamber 25 of the support member 11, the peripheral lip 33 engaging the undercut shoulder 27 therein. The securing arrangement 18 according to this possible embodiment is released by deflecting the arm 31 accessible though the aperture 35 of the second body portion 5 to thereby release the peripheral lip 33 from under the undercut shoulder 27.

Figure 5:
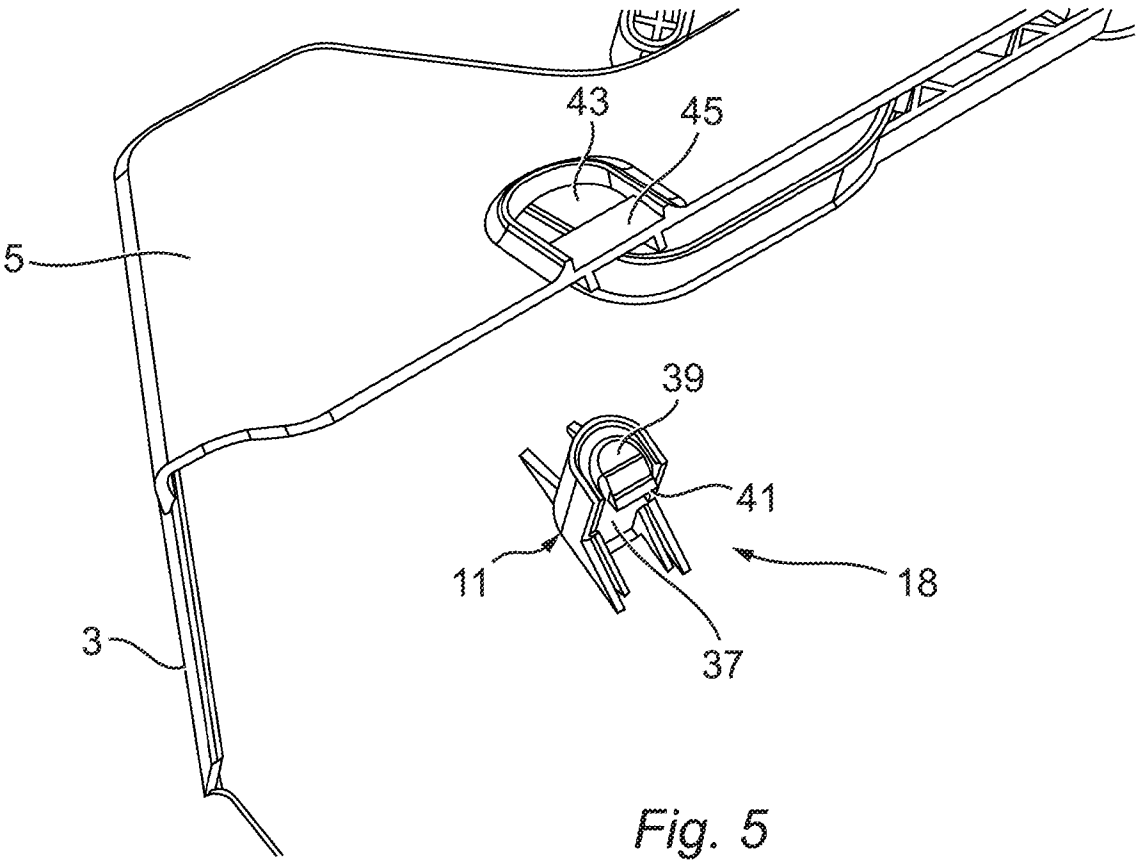
FIG. 5 is a detailed perspective view of a third preferred embodiment of the packaging assembly according to the present invention.

FIG. 5 shows another possible embodiment of the securing arrangement 18 according to the present invention. In this embodiment, the support member 11 may be in the form of an elongate post having a horse shoe cross section. Accommodated within the confines of the support member 11 is a straight arm clip 37 extending from the first body portion 3. An engagement tag 39 is provided at the free end of the straight arm clip 37, with a peripheral lip 41 located along a periphery of the engagement tag 39. A cooperating aperture 43 is provided in the second body portion 5, for accommodating the support member 11 and engagement tag 39 when the first and second body portions 3, 5 are in the closed position. The peripheral lip 41 of the straight arm clip 37 engages a peripheral edge 45 of the cooperating aperture 43 when in the closed position. The securing arrangement 18 can then be released by deflecting the straight arm clip 37 such that the peripheral lip 41 disengages the peripheral edge 45 of the cooperating aperture 43.

Figure 6:
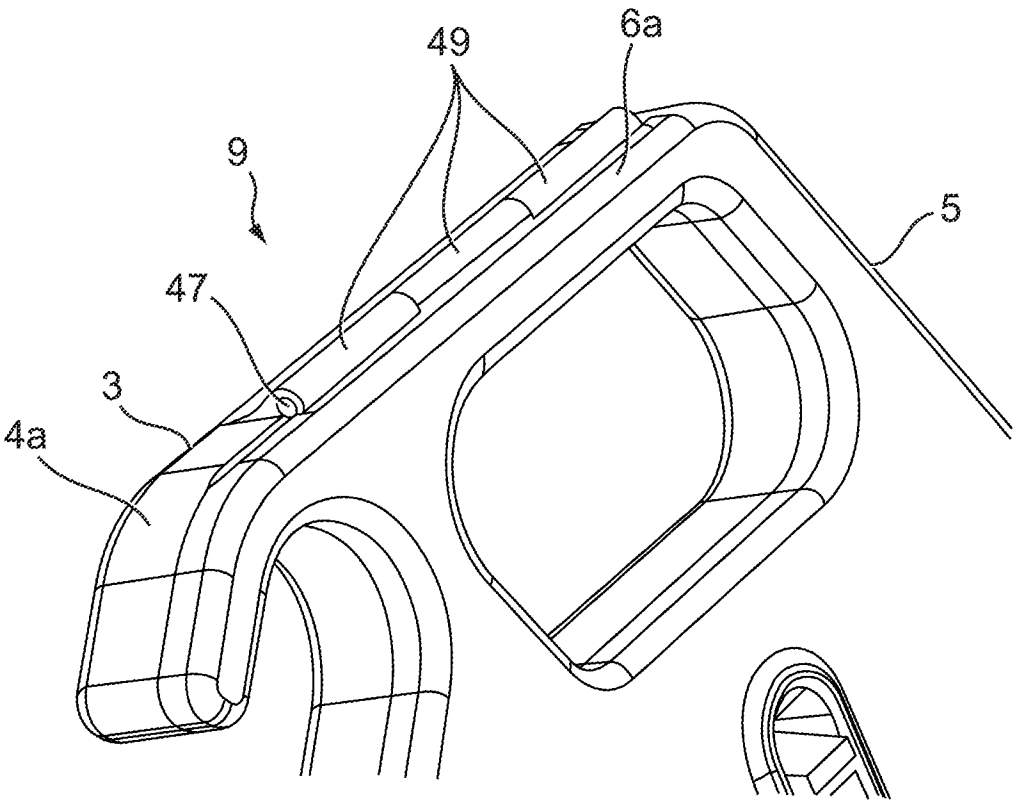
FIG. 6 is a detailed perspective view of a hinge of the packaging assembly according to the present invention.

FIG. 6 shows in more detail the hinge 9 of the packaging assembly 1 according to the present invention. The hinge 9 extends between the respective peripheral walls 4*a*, 6*a* of the first and second body portions 3, 5. And is a pin hinge similar to those used for doors. The hinge 9 therefore includes hinge sections 49, extending from each body portion 3, 5, each hinge section having a bore therein for accommodating a central hinge pin 47.

Figure 7:
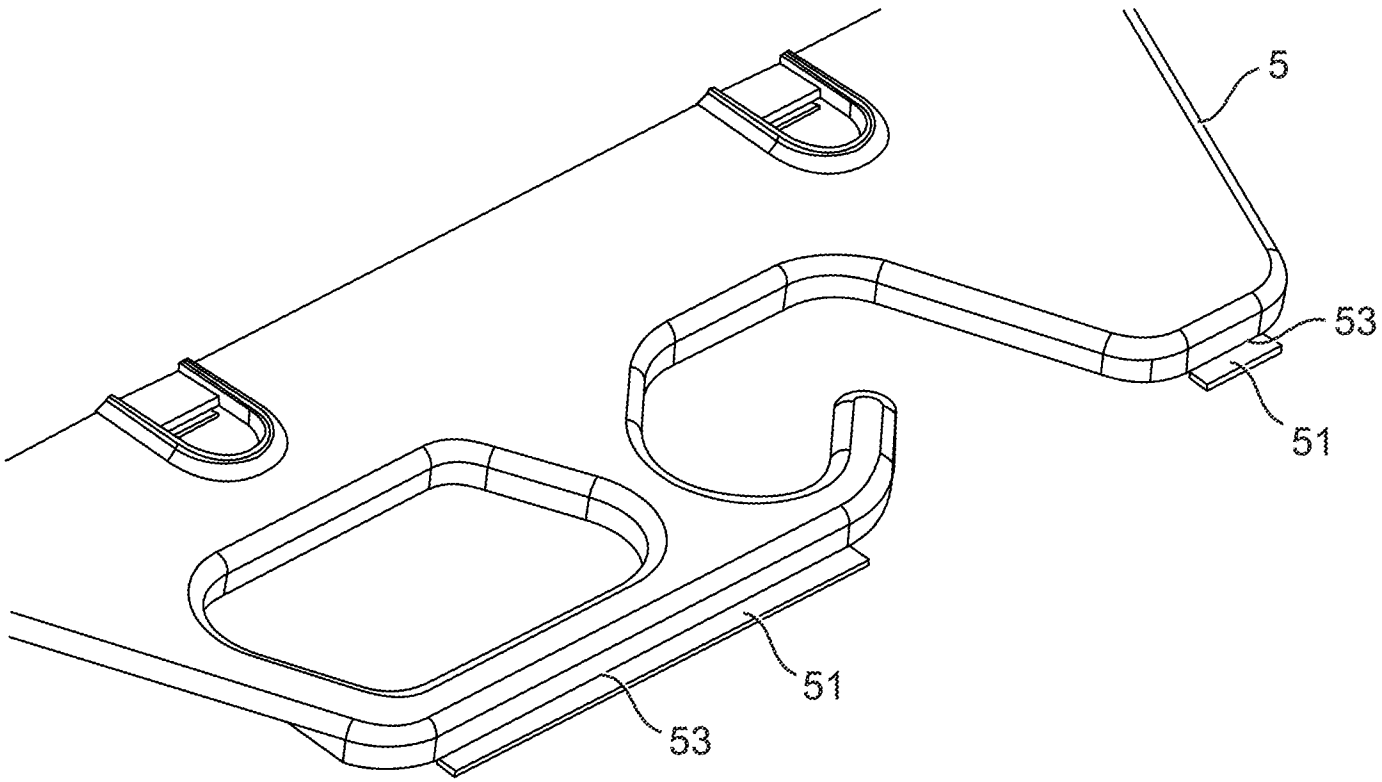
FIG. 7 is a detailed perspective view of an alternative hinge of the packaging assembly according to the present invention.

FIG. 7 shows an alternative embodiment of the hinge 7, 9. The second body portion 5 (and/or first body portion 3) can be provided with hinge tabs 51 integrally formed as part of the body portion 5. A bend line 53 can be provided along the line where the hinge tabs 51 joins the body portion 5. The hinge tabs 51 can be joined to the other body portion using fastening or other means as appropriate.

Figure 8:
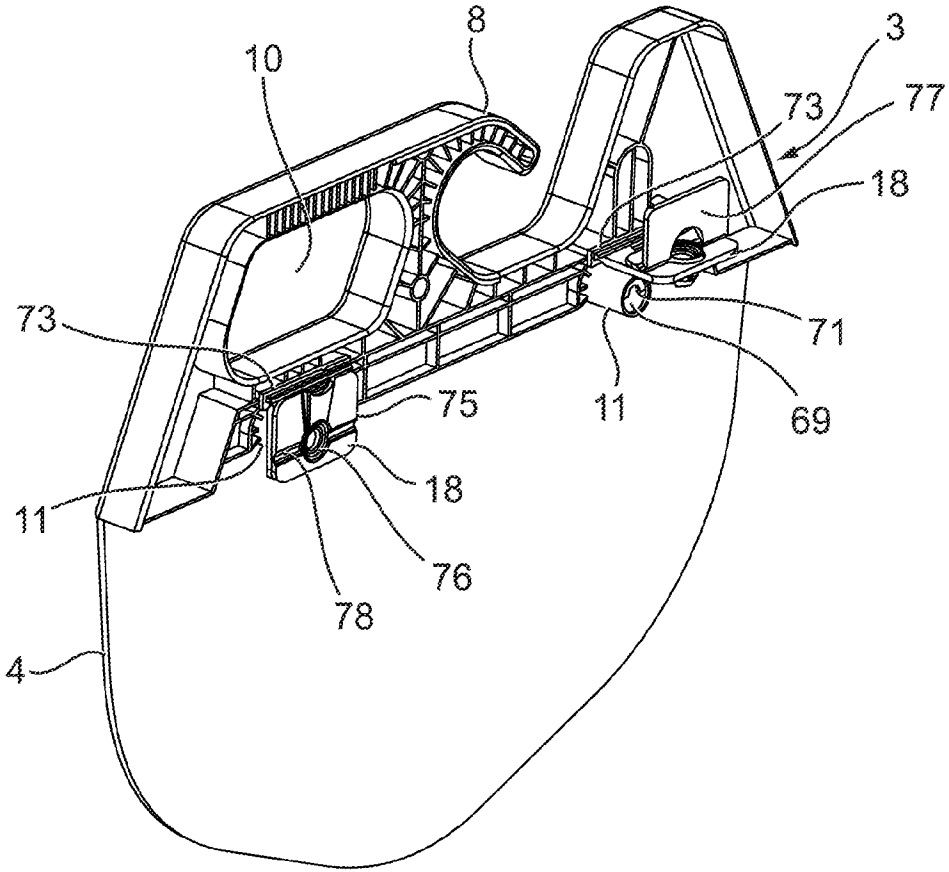
FIG. 8 is a rear perspective view of a fourth preferred embodiment of the packaging assembly according to the present invention.
Figure 9:
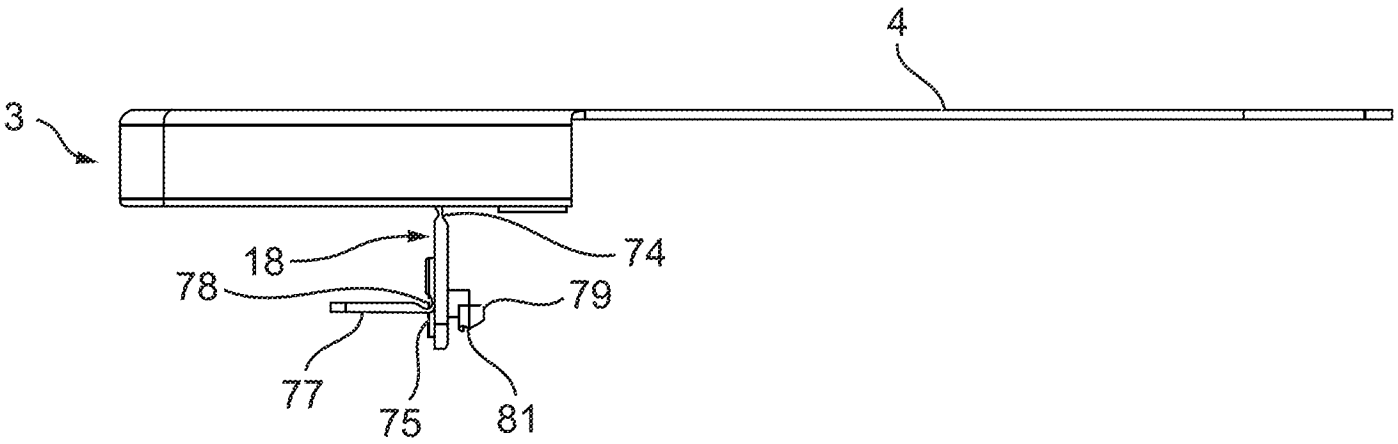
FIG. 9 is a side view of the packaging assembly shown in FIG. 8.

In the preferred embodiment shown in FIGS. 8 and 9, only one body portion 3 is used. There is no second body portion or associated hinge arrangement on the main body portion 3. This arrangement provides a lower cost and lighter weight option than the arrangement shown in the previously described embodiments having hinged body portions. The embodiment shown in FIGS. 8 and 9 is similar to the earlier embodiments in that the main body portion 3 has two support members 11 extending from a main planar wall 4 of the main body portion 3. A hook 8 is formed in an upper part of the main body portion 3 to allow hanging of the packaging assembly. Furthermore a handle portion 10 is provided in the main body portion 61 to allow carrying of the packaging assembly.

Each support member 11 is in the form of an elongate hollow post having a central bore 69. A cooperating lip 71 is provided in the central bore 69.

Support slots 73 are provided in the main body portion 61 adjacent to the support members 11 for supporting securing arrangements 18. These securing arrangements 18 are in the form of locking tabs respectively provided for engaging each support member 11. FIG. 8 shows two locking tabs 18, the left locking tab 18 being in a closed position, and the right locking tab 18 being in an open position. Each locking tab 18 includes a lock 75 rotatably supported about a pivot joint 76 on the locking tab 18. The lock 75 includes a handle 77 to allow for manual rotation of the lock 75. The handle 77 is connected to the lock 75 by a hinge connection 78 to enable the handle 77 to rest flat against the locking tab 18 when not in use, and to be hinged away from the rest of the locking tab 18 to extend laterally away from the locking tab 18 as best shown in the locking tab 18 in the open position in FIG. 8, and in FIG. 9 to thereby allow rotation of the lock 75. This provides a neat appearance for the packaging assembly when the locking tabs 18 are in a closed position, and the handle 77 is flush against the rest of the locking tab 18. The lock 77 furthermore includes an engagement member 79 having an abutment 81 for engaging the cooperating lip 71 of the support member 11. The locking tab 18 itself is formed with a central hinge joint 74, and the locking tab 18 therefore has a hinged portion 76 upon which is supported the lock 75. The hinged portion 76 is connected via the hinge 74 to a base portion (not shown) of the locking tab 18. The base portion is located within the slot 73 provided in the main body portion 3. This allows pivotal motion of the lock 77 towards and away from the support member 11.

Pivoting of the hinged portion 76 towards the support member 11 and rotation of the lock 75 results in engagement of the locking tab 18 with the support member 11. A car floor mat can therefore be retained on the support members 11 by passing the car floor mat over the support members 11 and securing each locking tab 18 to the support member 11 by rotation of the lock 75 such that the abutment 81 engages the peripheral lip 71 of the support member 11. The car floor mat can be released from the packaging assembly by rotating the lock 75 such that the abutment 81 disengages from the peripheral lip 71 thereby allowing the hinged portion 76 to pivot away from the support member 11.

The packaging assembly according to the present invention allows for straightforward repackaging of products such as car floor mats as well as being durable enough to be reused without damage to the packaging assembly.

Modification and variations as would be deemed obvious to the person skilled in the art are included within the ambit of the present invention as claimed in the appended claims.

What is claimed is:

1. A packaging assembly for car floor mats including a main body portion; at least one support member extending from the main body portion, and a securing arrangement releasably secured to the support member, wherein at least one car floor mat can be retained on the support member when the securing arrangement is secured to the support member, wherein the at least one car floor mat can be removed from the packaging assembly when the securing arrangement is released from the support member, wherein the securing arrangement includes a locking tab supported on the main body portion and having a lock for engaging the support member, and wherein the support member includes a cooperating lip, and wherein the lock includes an engagement member rotatably supported on the locking tab and having an abutment for engaging the cooperating lip of the support member in a first rotational position, the abutment being disengaged from the cooperating lip in a second rotational position of the lock.

2. The packaging assembly according to claim 1, wherein the locking tab includes a hinged portion supporting the lock, and allowing pivotal motion of the lock towards and away from the support member.

3. The packaging assembly according to claim 1, wherein the lock includes a handle hinged to the lock, the handle resting flush against the locking tab when not in use.

4. The packaging assembly according to claim 1, wherein two or more said support members are provided on the main body portion.

5. The packaging assembly according to claim 1, wherein the main body portion includes an integral hook portion for hanging the packaging assembly.

6. The packaging assembly according to claim 1, wherein the main body portion includes a planar extension for providing a support surface thereon.

7. The packaging assembly according to claim 1, further including one or more car floor mats supported therein.

* * * * *